United States Patent [19]

Chiu

[11] Patent Number: 4,973,376

[45] Date of Patent: Nov. 27, 1990

[54] METHOD FOR MANUFACTURING AIR-PERVIOUS INSOLE

[76] Inventor: Ou Y. Chiu, No. 231. Cheng Kung 3rd Road, Nantou City, Taiwan

[21] Appl. No.: 386,093

[22] Filed: Jul. 28, 1989

[51] Int. Cl.[5] ..... A43B 10/00

[52] U.S. Cl. ..... 156/254; 12/146 B; 12/146 BR; 36/44; 156/252; 156/265; 264/156

[58] Field of Search ..... 12/146 B, 146 BR; 36/44, 71, 3 B; 156/153, 154, 254, 252, 253, 265, 267; 264/139, 156

[56] References Cited

U.S. PATENT DOCUMENTS 4,586,273 5/1986 Chapnick ..... 36/44
4,674,204 6/1987 Sullivan et al. ..... 36/44
4,781,774 11/1988 Steward et al. ..... 156/254 X

FOREIGN PATENT DOCUMENTS 738494 10/1955 United Kingdom ..... 154/125 B

*Primary Examiner*—David Simmons
*Assistant Examiner*—James J. Engel, Jr.
*Attorney, Agent, or Firm*—Browdy and Neimark

[57] ABSTRACT

A method for manufacturing an air-pervious insole being uneasily deformable is provided. The method includes (1) preparing from a foaming material an elastic base piece having through holes, (2) cutting from the base piece a layer of the foamed material to present a rough surface, (3) adhering a cloth layer on the rough surface, then (4) baking to soften the base piece, then (5) molding in a cooling mold, and finally cutting the cooled and molded piece to obtain an air-pervious insole.

3 Claims, 3 Drawing Sheets

METHOD FOR MANUFACTURING AIR-PERVIOUS INSOLE

BACKGROUND OF THE INVENTION

The present invention relates to a method for manufacturing an insole, and more particularly to one for manufacturing an air-pervious insole.

Insoles for sport shoes can be categorized into two types, i.e. ventilating hole-provided ones and non-ventilating hole-provided ones. The method for manufacturing the latter includes (1) obtaining an elastic base piece of a foamed material, (2) adhering a cloth layer on the base piece, (3) baking the cloth layer-adhered base piece to soften the base piece, (4) molding the baked cloth layer-adhered base piece in a cooling mold, and (5) cutting the cooled and molded piece to obtain an insole which is not ventilating hole-provided so that the foaming material to be used to obtain the elastic base piece must be air-pervious, e.g. the PU, and cannot be air-impervious, e.g. the EVA in order that a foot will not easily sweat to prevent the foot from producing a bad odor or becoming an athlete's foot.

Generally speaking, there are two methods for manufacturing the former. The first one includes in addition to the above five steps a step of perforating the obtained insole which will thus include on the cloth layer perforated holes which must have a relatively small size in order that the foot, regardless of wearing a sock or not, stepping thereon will not feel uncomfortable. The second one includes (1) baking directly the obtained elastic base piece, (2) molding and perforating the baked base piece, (3) adhering a cloth layer on the perforated base piece, and (4) cutting the cloth layer-adhered base piece to obtain an insole which includes on the cloth layer no holes, however, adhering the cloth layer to the molded base piece is difficult and troublesome.

Upon shaping, it is the inherent characteristic of the foaming material that the foamed piece will form on all of its surface a film layer having a hardness and a materiality better than those of the foamed piece at any point other than the film layer. The base piece in any of the above described manufacturing methods can hardly contain the film layer since the base piece is sliced from a relatively thick foamed piece, so that the manufactured insole is easily deformable to thin the base piece to reduce the shock absorptivity and to decrease the holed percentage to deteriorate the air-perviousness which originates from the fact that the density of the thinned elastic base piece is increased for a non-ventilating hole-provided insole and the bore of the ventilating holes of the thinned base piece is reduced for a ventilating hole-provided insole.

In addition, the ventilating holes of the ventilating hole-provided insole are not provided on the arcuate portion and the edges of the insole where to perforate is difficult and thus the air-perviousness of the insole is not ideal.

It is therefore tried by the Applicant to deal with all of the above problems encountered by the prior art.

SUMMARY OF THE INVENTION

It is therefore an object of the present invention to provide a method of manufacturing an air-pervious insole capable of using any kind of foaming material.

It is further an object of the present invention to provide a method of manufacturing an air-pervious insole including a cloth layer having no holes and capable of being adhered without much difficulty.

It is an additional object of the present invention to provide a method of manufacturing an air-pervious insole having a base piece containing a continuous film layer so that the base piece is not easily deformable and has better shock absorptivity and air-perviousness.

It is yet an object of the present invention to provide a method of manufacturing an air-pervious insole having a base piece densely distributed with ventilating holes.

According to the present invention, a method of manufacturing an air-pervious insole includes (1) preparing by moulding or injection molding an elastic base piece from a foaming material in the manner that the base piece has a multiplicity of through holes, (2) cutting from the base piece a layer of the foamed material to present a rough surface, (3) adhering a cloth layer on the rough surface, (4) baking the cloth layer-adhered base piece to soften the base piece, (5) molding the baked cloth layer-adhered base piece in a cooling mold, and (6) cutting the cooled and molded piece to obtain the air-pervious insole.

The present invention may best be understood through the following description with reference to the accompanying drawings, in which:

DETAILED DESCRIPTION OF THE PREFERRED EMBODIMENT

Figure 1:
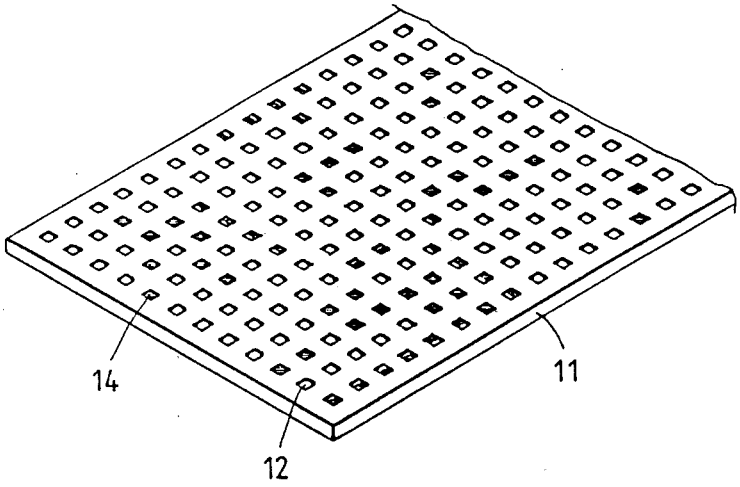
FIG. 1 is a perspective view showing an elastic base piece prepared by a method of manufacturing an air-pervious insole according to the present invention.
Figure 2:
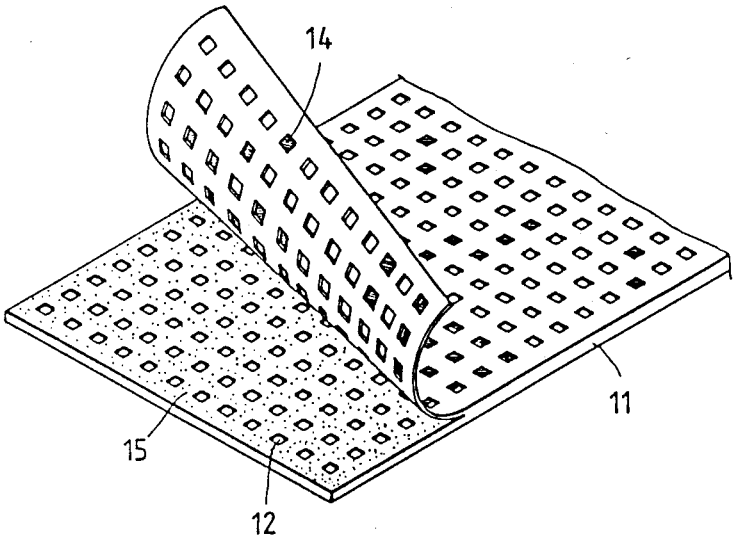
FIG. 2 is a perspective view showing a step of cutting a layer of foamed material from an elastic base piece in FIG. 1.
Figure 3:
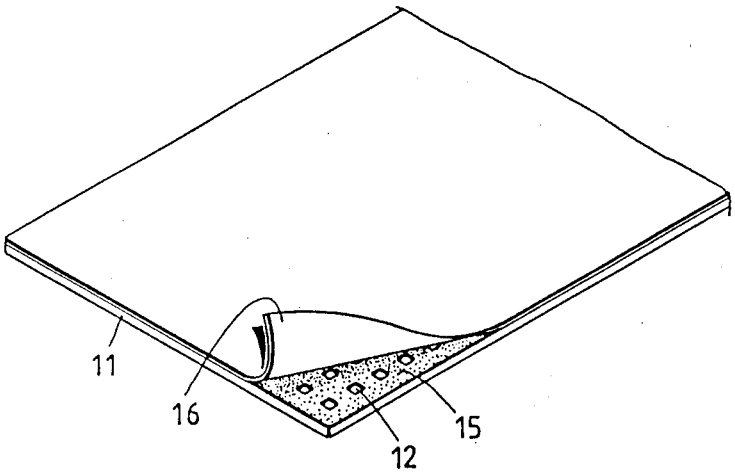
FIG. 3 is a perspective view showing an operation of adhering a cloth layer on a rough surface of a base piece in FIG. 1.
Figure 4:
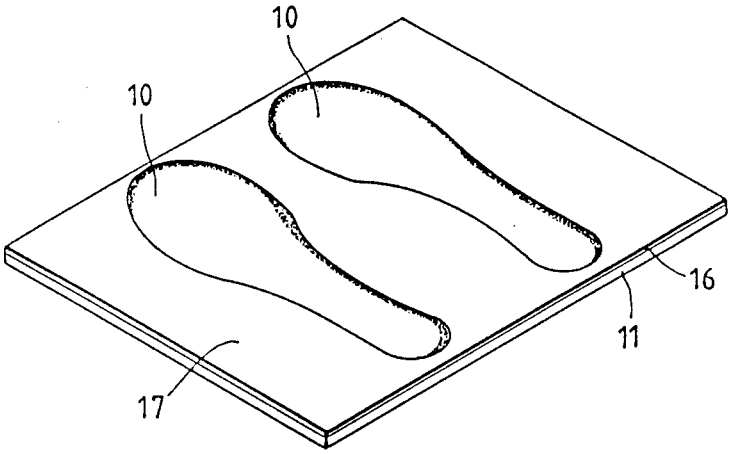
FIG. 4 is a perspective view showing a molded cloth layer-adhered base piece manufactured by a method according to the present invention.
Figure 5:
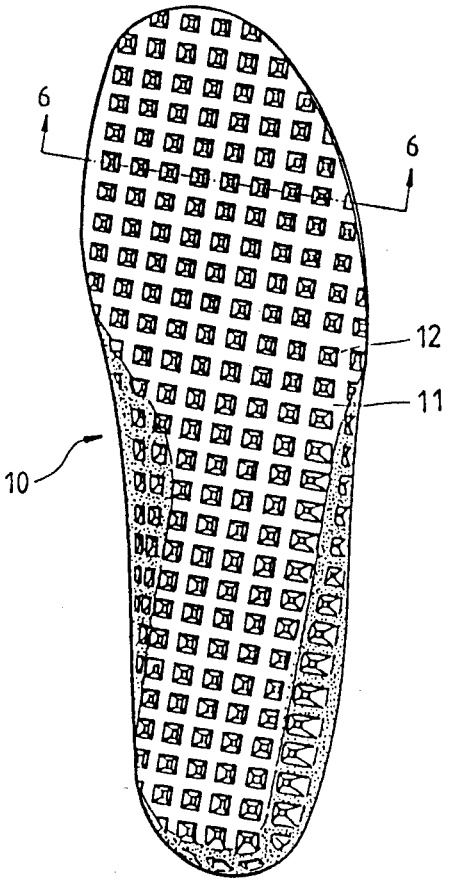
FIG. 5 is a perspective view showing an insole manufactured by a method according to the present invention.
Figure 6:
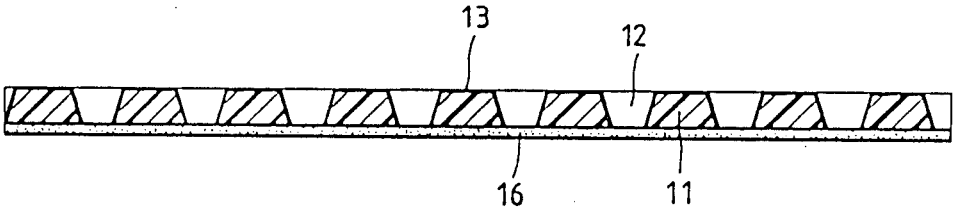
FIG. 6 is a sectional view taken along the line 6—6 in FIG. 5.

Referring now to FIGS. 1–6, a method of manufacturing an air-pervious insole according to the present invention includes the steps of (1) preparing by moulding or injection moulding an elastic base piece 11 from a foaming material in the manner that base piece 11 includes a multiplicity of through holes 12 being tapered parallelepiped-shaped and forms everywhere a continuous film layer 13 on its surface, (2) cutting or slicing from one side surface of base piece 11 a layer of foamed material to present a rough surface 15 and to ensure that any of through holes 12 is not blocked by a possible film 14 (in FIG. 2) formed by the foaming material leaking into the mold junction, (3) adhering a cloth layer 16 on rough surface 15, (4) baking the cloth layer-adhered base piece of a predetermined size to soften base piece 11, (5) molding the baked cloth layer-adhered base piece in a cooling mold to obtain a semi-finished product (as shown in FIG. 4), and (6) cutting the redundant portion 17 off the semi-finished product to obtain an insole 10 according to the present invention.

The advantages achieved by the present invention can be summarized as follows:

(1) The present invention can use any kind of foaming material regardless of having a good air-perviousness or not.

(2) The cloth layer contains no holes and is adhered to the elastic base piece before the cloth layer-adhered base piece is molded so that the adhering procedure is relatively easy.

(3) The film layer extends everywhere on the surface of the base piece (11) including the wall of all of the through holes (12) so that the stuctural strength of the place surrounding the through holes (12) will be higher than that of the place surrounding the through holes perforated on the prior insole since the film layer (13) has a better hardness and a better materiality. Thus, the present insole will less deform upon being compressed and will have better shock absorptivity and air-perviousness.

(4) The ventilating through holes of the present insole are densely distributed all over the base piece including the arcuate portion and the edge of the insole so that it has an excellent air-pervious property.

What I claim is:

1. A method for manufacturing an air-pervious insole comprising:

preparing an elastic base piece from a foaming material in a manner that said base piece has a multiplicity of through holes and forms a continuous film layer on any surface thereof:

cutting from one side surface of said base piece a layer of said foamed material to provide a rough surface and to ensure that any of said through holes blocked by foaming material leaking into a mold junction is not blocked;

adhering a cloth layer on said layer of material having a rough surface;

baking said cloth layer-base piece to soften said base piece;

molding said baked cloth layer-base piece in a cooling mold, and cutting said cooled and molded piece to obtain an air-pervious insole, wherein through holes are distributed over said base piece and arcuate and edge portions of said insole.

2. A manufacturing method according to claim 1, wherein said base piece in step 1 is prepared by molding.

3. a manufacturing method according to claim 1 wherein said base piece in step 1 is prepared by injection moulding.

* * * * *